United States Patent [19]

Oguro et al.

[11] 4,205,257

[45] May 27, 1980

[54] MAGNETRON STRAP RING STRUCTURE

[75] Inventors: Tomokatsu Oguro, Mobara; Tatsuji Sakamoto, Inashiki; Akio Yasukawa, Shimoinayoshi, all of Japan

[73] Assignee: Hitachi Ltd., Tokyo, Japan

[21] Appl. No.: 918,812

[22] Filed: Jun. 26, 1978

[30] Foreign Application Priority Data

Sep. 7, 1977 [JP] Japan ..... 52-119359[U]

[51] Int. Cl.[2] ..... H01J 23/22

[52] U.S. Cl. ..... 315/39.69; 315/39.51; 315/39.75

[58] Field of Search ..... 315/39.51, 39.69, 39.75

[56] References Cited

U.S. PATENT DOCUMENTS

| | | | |
|---|---|---|---|
| 2,456,888 | 12/1948 | Okress | 315/39.69 |
| 2,777,090 | 1/1957 | Volz | 315/39.69 |
| 3,553,524 | 1/1971 | Hill | 315/39.69 |
| 3,875,469 | 4/1975 | Sato et al. | 315/39.69 |

FOREIGN PATENT DOCUMENTS

| | | | |
|---|---|---|---|
| 848920 | 9/1960 | United Kingdom | 315/39.69 |

*Primary Examiner*—Saxfield Chatmon, Jr.
*Attorney, Agent, or Firm*—Charles E. Pfund

[57] ABSTRACT

The radial vanes secured to the inside of a cylindrical anode electrode are short-circuited by inner and outer strap rings which are secured to alternate vanes. The intermediate portions of the strap rings between the points at which the strap rings are secured to the vanes are projected outwardly.

3 Claims, 6 Drawing Figures

MAGNETRON STRAP RING STRUCTURE

BACKGROUND OF THE INVENTION

This invention relates to a magnetron utilized in a microwave oven, defrosting machine or the like, and more particularly a magnetron having an improved strap ring secured to radial vanes.

As shown in FIGS. 1 and 2, a prior art magnetron comprises a cylindrical anode 1 made of copper, a plurality of copper radial vanes 2 secured to the inner wall of the anode and a strap ring 3 comprising inner and outer strap rings 3B and 3A respectively connected to alternate vanes by brazing 4 for short-circuiting interconnected vanes. At the center of the anode electrode 1 is positioned a cathode electrode 5 having a filament 5A. The opposite ends of the anode electrode 1 are hermetically sealed by end plates 6 and 7 to form an evacuated vessel.

When an electric power is applied to the magnetron, the filament 5A is heated to emit thermoelectrons which are accelerated by the electric field established between the anode and cathode electrodes 1 and 5 to interact with the magnetic field created by permanent magnets, not shown, whereby the electrons oscillate in an interaction space defined between the inner ends of the vanes and the cathode electrode to generate a high frequency electromagnetic wave. Finally, the electrons collide against the inner ends of the vanes to generate heat which is dissipated by the outer surface of the anode electrode 1 through the vanes. Accordingly, the temperature of the vanes 2 is higher than that of the anode electrode 1 and the vanes expand inwardly as shown by dotted lines shown in FIG. 3 due to thermal expansion. On the other hand, as the termperature rises, the strap ring 3 tends to expand outwardly. However, since the strapping 3 is soldered to the vanes, only the portions of the strap ring 3 between the soldered point to the vanes can expand outwardly as shown by dotted lines in FIG. 3. Consequently, large stresses are applied to the joints between the vanes and the strap ring. Accordingly, as the power ON-OFF of the magnetron is repeated, the application of the stresses is repeated causing rupture of the strap ring by fatigue, thereby shortening the life of the magnetron.

SUMMARY OF THE INVENTION

Accordingly, the principal object of this invention is to provide an improved magnetron wherein the fatigue rupture of the strap ring is decreased and the life is increased.

According to this invention, there is provided a magnetron of the type comprising a cathode electrode, a cylindrical anode electrode concentrically surrounding the cathode electrode, a plurality of radial vanes secured to the inner surface of the anode electrode for defining an interaction space between the inner ends of the vanes and the cathode electrode, and concentric inner and outer strap rings which are secured to alternate vanes to short-circuit the same, wherein intermediate portions of strap rings between points at which the strap rings are secured to the vanes are projected outwardly from circles passing through the securing points.

DESCRIPTION OF THE PREFERRED EMBODIMENTS

Figure 4:
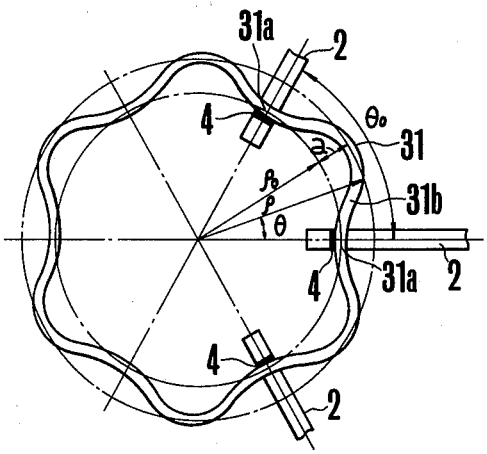
FIG. 4 is a plan view showing one embodiment of the strap ring embodying the invention.

As shown in FIG. 4, a strap ring 31 of this invention is characterized in that an intermediate portion 31*b* of the strap ring 31 between stationary portions 31*a* at which the strap ring is soldered as shown by 4 to the vanes 2 projects outwardly by a length a from a circle passing through the stationary portions 31*a* and having a radius $\rho_0$. Although in FIG. 4 only an illustration of the inner strap ring 31 is shown, it should be understood that the outer strap ring, not shown, has the same construction.

Figure 1:
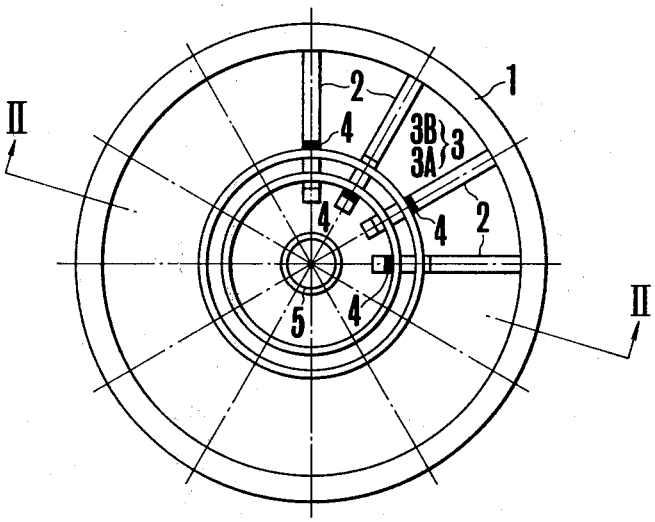
FIG.1 (PRIOR ART)
FIG. 1 is a plan view showing the essential elements of a prior art magnetron.
Figure 2:
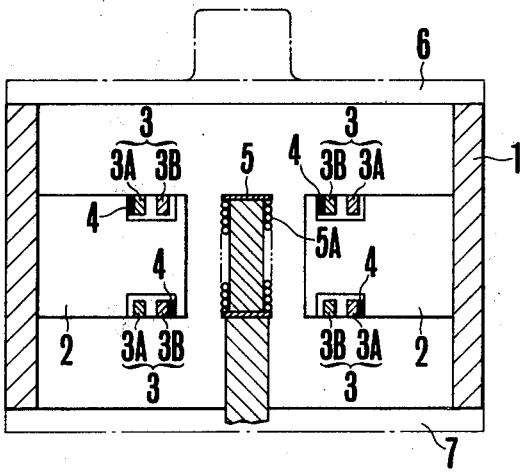
FIG.2 (PRIOR ART)
FIG. 2 is a longitudinal sectional view taken along a line II—II in FIG. 1.
Figure 3:
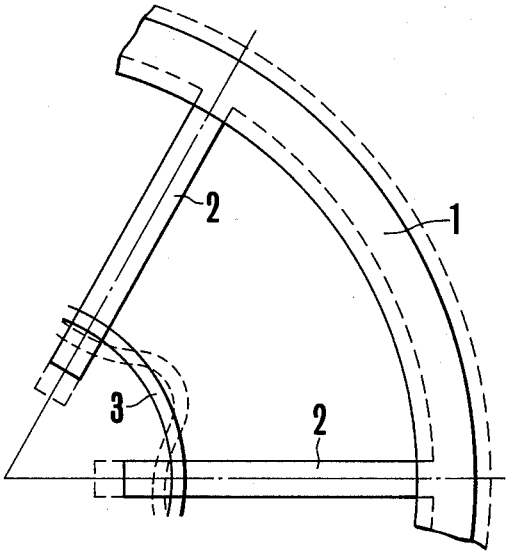
FIG. 3 is a partial enlarged view useful to explain the thermal deformation of various elements of the magnetron shown in FIGS. 1 and 2.

When the inner ends of the vanes 2 extend inwardly as shown in FIG. 3 due to thermal expansion, the stationary portions 31*a* of the strap ring 31 move to the inside by the same amount as the vanes in the same manner as in a strap ring having the prior art construction. Where the intermediate portion 31*b* is projected outwardly by a maximum amount a according to this invention, it was found by experiment that the vertical stress and the bending stress created in the intermediate portion 31*b* when the stationary portions 31*a* move inwardly decrease as compared with the prior art construction where no projection is provided as will be discussed later with reference to FIG. 5. As a consequence, even when the thermal deformation is repeated as a result of power ON-OFF operations, the fatigue of the strap ring 31 decreases greatly, thus greatly prolonging the life. Although the configuration of the projection is not limited to any definite shape, where the projection takes the form of a sine curve as shown in FIG. 4, its configuration is expressed by the following equation which represents the variation of radius $\rho$ with respect to angle $\theta$, $$\rho = \rho_0 + \frac{a}{2}\left[1 + \sin\left(\frac{2\pi\theta}{\theta_0} - \frac{\pi}{2}\right)\right],$$

where $\theta_0$ represents an angle between adjacent stationary portions 31*a* of the strap ring.

Figure 5:
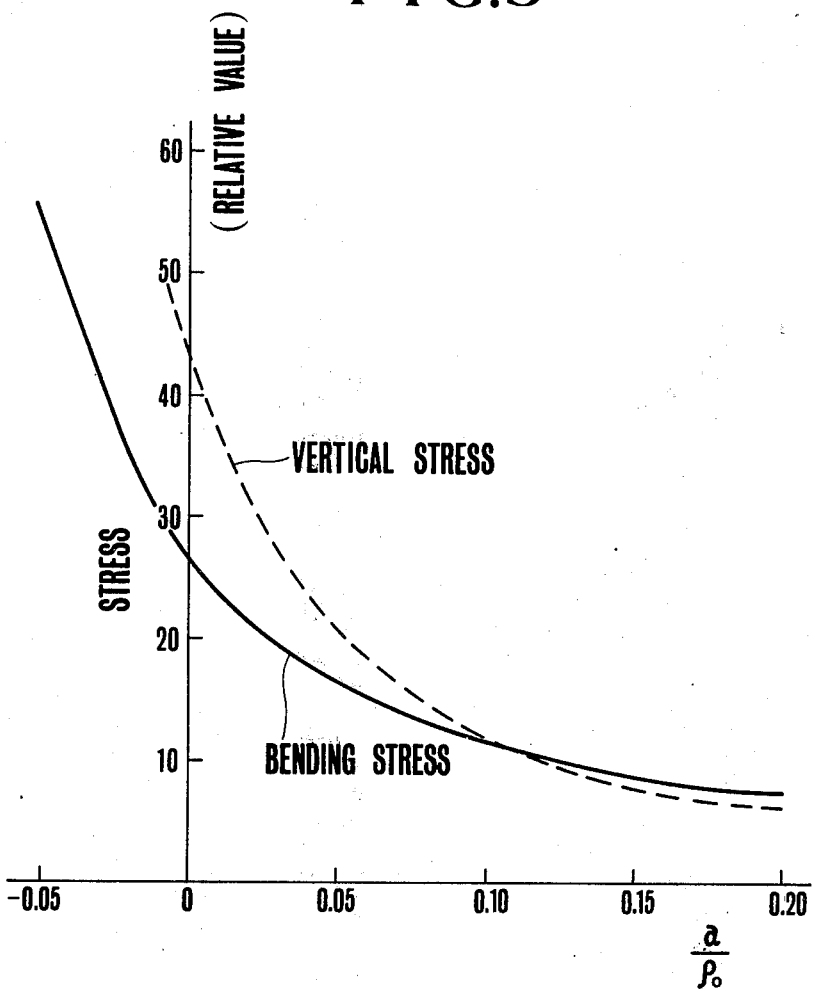
FIG. 5 is a graph showing the relationship between the amount of projection of the strap ring and the stress.
Figure 6:
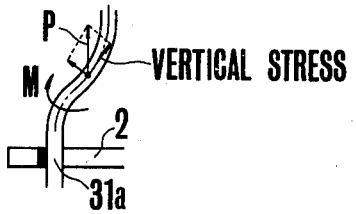
FIG. 6 is a diagrammatic representation useful to explain the stress created in the strap ring due to the thermal deformation of the vane.

FIG. 5 shows the measured stresses at the intermediate portion 31*b* of the strap ring 31, in which abscissa represents the ratio of the amount of projection a and the radius $\rho_0$ (9 mm) of the strap ring at the stationary portions, that is $a/\rho_0$, whereas ordinate represents the stress. The graph shown in FIG. 5 shows the vertical stress and the bending stress created in the intermediate portion over a range of $\theta = 30°$ starting from the stationary portion. The vertical stress means the tangential component of the stress P at a point on the intermediate portion whereas the bending stress a stress that forms a moment M, as shown in FIG. 6. FIG. 6 shows the stress which is created when the strap ring has deformed as shown. Where the strap ring is preformed to have an intermediate projection, there is no stress at the initial state and the stress is created as shown in FIG. 6 only when the strap ring undergoes thermal deformation.

As can be noted from FIG. 5, the stress decreases as the amount of projection a increases, but there is a limited for the decrease in the stress.

Where $a/\rho_0=0.05$ to 0.08, the stress decreases to one half the stress created in a strap ring provided with no projection. Where $\rho_0=9$ mm, then $a=0.45$ to $0.72=0.6$ mm. Where $a/\rho_0$ is negative, that is, where the intermediate portions project inwardly from the circle having radius $\rho_0$, the stress increases as compared to a case where no projection is provided.

As has been described hereinabove, according to this invention, the influence upon the inner and outer strap rings caused by thermal stress can be alleviated, thereby increasing the life of the magnetron.

What is claimed is:

1. In a magnetron of the type comprising a cathode electrode, a cylindrical anode electrode concentrically surrounding the cathode electrode, a plurality of radial vanes secured to the inner surface of said anode electrode for defining an interaction space between the inner ends of said vanes and said cathode electrode, and concentric inner and outer strap rings which are secured to alternate vanes to short-circuit the same, the improvement wherein intermediate portions of said strap rings between the points at which the strap rings are secured to said vanes are projected outwardly from circles passing through said securing points, and wherein each strap ring lies entirely in a plane perpendicular to the axis of the cylindrical anode.

2. The magnetron according to claim 1 wherein each projection has a form expressed by an equation, $$\rho = \rho_0 + \frac{a}{2}\left(1 + \sin\left(\frac{2\pi\theta}{\theta_0} - \frac{\pi}{2}\right)\right),$$

where $\rho$ represents the distance from the axis as a function of the angle $\theta$ about such axis, $\rho_0$ represents the radius of said circle passing through said securing points, a represents the maximum amount of projection, and $\theta_0$ the angle between the secured points and where $0<\theta<\theta_0$.

3. The magnetron according to claims 1 or 2 wherein said strap rings are substantially uniform in a plane perpendicular to the axis of the cylindrical anode.

* * * * *